US005897051A

United States Patent [19]

Tessier et al.

[11] Patent Number: 5,897,051

[45] Date of Patent: Apr. 27, 1999

[54] CARRIER BOX

[75] Inventors: Sylvain Tessier, Bellefeuille; Bruno Beauchamp, St-Lazare; Gerry Zampini, Dorval, all of Canada

[73] Assignee: Rolland Inc., Montreal, Canada

[21] Appl. No.: 09/024,135

[22] Filed: Feb. 17, 1998

Related U.S. Application Data

[63] Continuation-in-part of application No. 08/773,777, Dec. 26, 1996, Pat. No. 5,718,369.

[51] Int. Cl.[6] ..... B65D 5/475

[52] U.S. Cl. ..... 229/117.13; 229/125.19; 229/125.38; 229/199

[58] Field of Search ..... 229/125.19, 125.38, 229/199, 117.12, 117.13, 117.14

[56] References Cited

U.S. PATENT DOCUMENTS

| | | | |
|---|---|---|---|
| 1,140,231 | 5/1915 | Agar . | |
| 1,993,516 | 3/1935 | Kells . | |
| 2,706,591 | 4/1955 | Sheard . | |
| 2,761,608 | 9/1956 | Welshenbach . | |
| 2,880,866 | 4/1959 | Van Dyck . | |
| 3,012,660 | 12/1961 | Sheldon, Jr. . | |
| 3,094,268 | 6/1963 | Swanson et al. . | |
| 4,222,485 | 9/1980 | Focke . | |
| 4,418,864 | 12/1983 | Nielson . | |
| 4,567,070 | 1/1986 | Karass . | |
| 4,817,866 | 4/1989 | Wonnacott . | |
| 5,718,369 | 2/1998 | Delisle et al. | 229/117.13 |

*Primary Examiner*—Gary E. Elkins
*Attorney, Agent, or Firm*—Birch, Stewart, Kolasch & Birch, LLP

[57] ABSTRACT

A container for printer paper or the like formed of a rectangular bottom part containing the paper and a rectangular cover having peripheral flanging which enables the cover to fit exactly over the bottom part. The cover is formed with a deformable band which is integral with the material of the cover and constitutes the handle of the container. The band is obtained by providing the cover with two cuts which extend side by side between two opposite upper edges of the cover. In the middle part of the cover, the cuts deviate to form two rectangular tabs. The cuts also extend downwardly past the upper edges a short distance to enable the band to arch upwardly when upwardly pulling it. The cuts are oriented in such a way that the band is widest at the cover edges, and narrowest at the ends of the cut extensions and at the middle part of the cover. To prevent any damage to the handle while carrying the carrier box, a reinforcing belt is wrapped around the bottom part and cover while remaining in contact with the band.

12 Claims, 5 Drawing Sheets

CARRIER BOX

CROSS-REFERENCE

This application is a continuation-in-part of U.S. application Ser. No. 08/773,777 filed Dec. 26, 1996, now U.S. Pat. No. 5,718,369.

BACKGROUND OF INVENTION (a) Field of the Invention

This invention relates to a carrier box. More particularly, the present invention is concerned with a container for printer paper or the like which is provided with handle means enabling to easily carry the box from one location to another.

(b) Description of Prior Art

The development of the computer has given rise to an enormous consumption of paper which is customarily stored in small cardboard boxes. Now, it is quite normal to carry these boxes from one location to another, generally by grabbing the entire box and to hand carry it to a chosen place. Of course, all sorts of means are provided to facilitate the handling of these boxes. However, to this date, the art has not suggested something that is inexpensive, easy to produce and convenient to use in handling carrier boxes, especially those that are utilized to contain printer paper.

U.S. Pat. No. 2,880,866 issued Apr. 7, 1959 to W. J. Van Dyck discloses a shipping package for paper, which however has no means to handle it.

U.S. Pat. No. 3,012,660 issued Dec. 12, 1961, inventor Water T. Sheldon, Jr., relates to a shipping container including a prismatic body, closure caps and a strap to secure the parts together.

U.S. Pat. No. 4,418,864 issued Dec. 6, 1983, inventor John C. Nielsen, describes a carton with handle which is made of a strip of reinforcing tape which is secured to the side walls of the carton.

U.S. Pat. No. 4,567,070 issued Jan. 28, 1986, inventor Thomas J. Karass, is concerned with a container having a handle integral therewith and a tape inserted between the layers of the box and also between those forming the handle. Although giving some satisfaction, this article is complicated and expensive to manufacture.

U.S. Pat. No. 4,817,866 issued Apr. 4, 1989, inventor Roger J. Wonnacott, is another example of a tape incorporated into the material of the box and of the handle to reinforce the latter.

Other patents of interest for storing sheet material including computer forms, include U.S. Pat. No. 1,140,231 issued May 1915 to Agar U.S. Pat. No. 1,993,516 issued March 1935 to Kells U.S. Pat. No. 2,706,591 issued April 1955 to Sheard U.S. Pat. No. 2,761,608 issued September 1956 to Welshenbach U.S. Pat. No. 3,094,268 issued June 1963 to Swanson et al U.S. Pat. No. 4,222,485 issued September 1980 to Focke It will be realized that there is a need for a cheap container which includes a reinforced handle.

SUMMARY OF INVENTION

It is an object of the present invention to provide a carrier box which incorporates a reinforced handle that is easy to manufacture and cheap to produce.

It is another object of the present invention to provide a container for printer paper which is built with an integrated handle and is reinforced with a plastic belt wrapping the container including the handle part.

These and other objects of the invention may be achieved by providing a container for printer paper or the like, which comprises a rectangular bottom part to contain said paper, a rectangular cover made of a substantially rectangular blank having flange-forming folding lines provided therein to define peripheral flanges enabling to fit said cover over said bottom part, said flange-forming lines being placed on said blank to coincide with upper edges of said cover, said blank additionally comprising a pair of transverse cuts which extend side by side all the way between a pair of said flange forming lines to form a first portion of a band, said transverse cuts also extending past said pair of folding lines in opposite direction to form a second portion of said band, said first and second portions combining to enable said band to arch upwardly when said band is being pulled, thereby forming a handle for said container, the first portion of each cut extending linearly from said pair of flange forming folding lines towards a middle part of said blank where said cut outwardly deviates to define an upwardly folding tab, and a reinforcing belt to wrap around said bottom part and said cover over said band when said cover is in position over said bottom part, and means enabling said reinforcing belt to follow and remain in substantial contact with said band when said band is formed into said handle.

BRIEF DESCRIPTION OF DRAWINGS

The invention is illustrated but is not limited by the annexed drawings which show a preferred embodiment and in which.

DESCRIPTION OF PREFERRED EMBODIMENT

Figure 1:
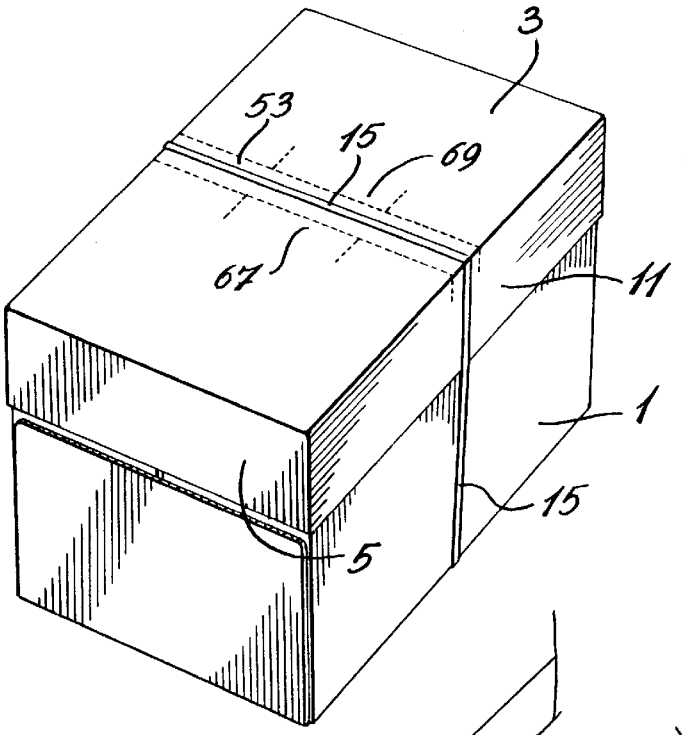
FIG. 1 is a perspective view of a carrier box according to the invention, provided with a wrapping belt.

With reference to the drawings, it will be seen that the carrier box according to the invention is especially designed as a container for printer paper or the like, and is entirely made of cardboard. Of course, the carrier box may be designed for other purpose, i.e. to contain any type of product and may be made of any kind of material, such as plastic.

As illustrated, the carrier box essentially consists of a rectangular bottom part 1, which is designed to contain printer paper, a rectangular cover 3 formed with flanges 5, 7, 9 and 11, a handle 13 and a wrapping belt 15. As shown, the flanges are folded as will be discussed later so as to enable the cover to fit exactly over bottom part 1.

In the embodiment illustrated, both the bottom part 1 and cover 3 are made of cardboard although, as discussed previously, any other type of material could be used. Handle 13 is integral with the material of cover 3 as will be discussed later.

Figure 3:
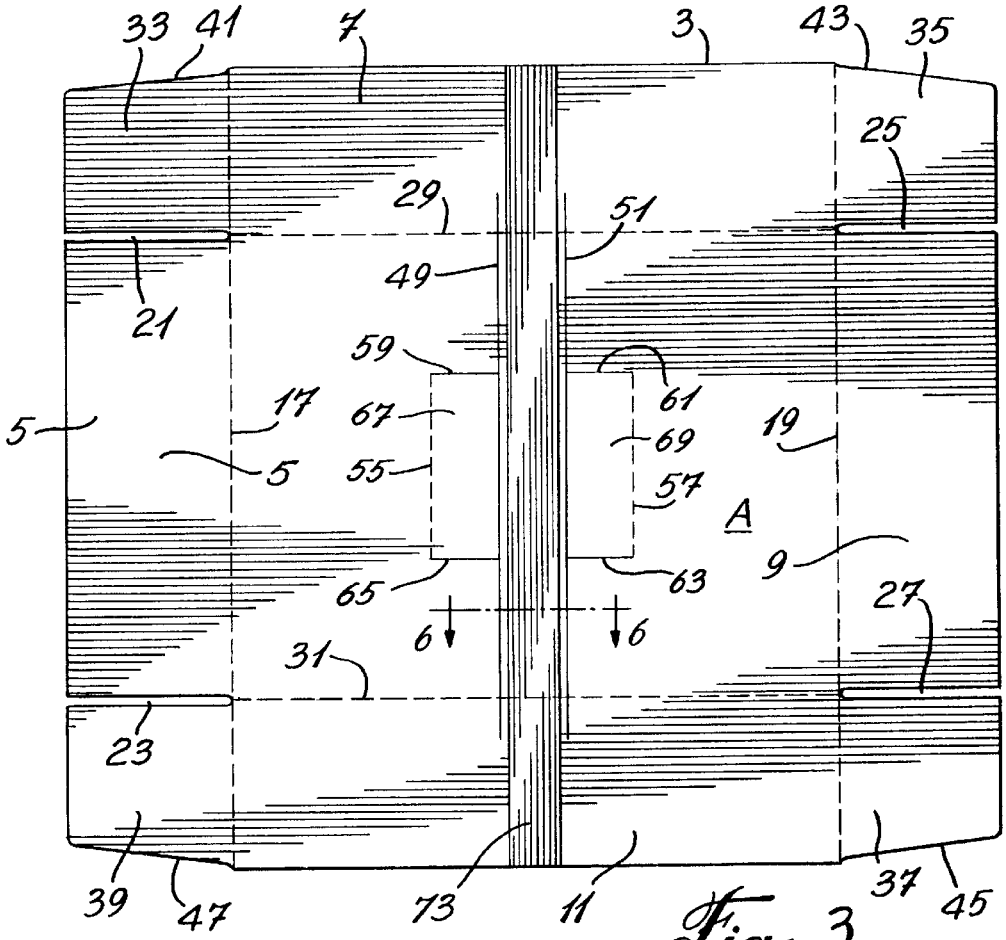
FIG. 3 is a view of a blank which may be used to manufacture the cover of a carrier box according to the invention.
Figure 4:
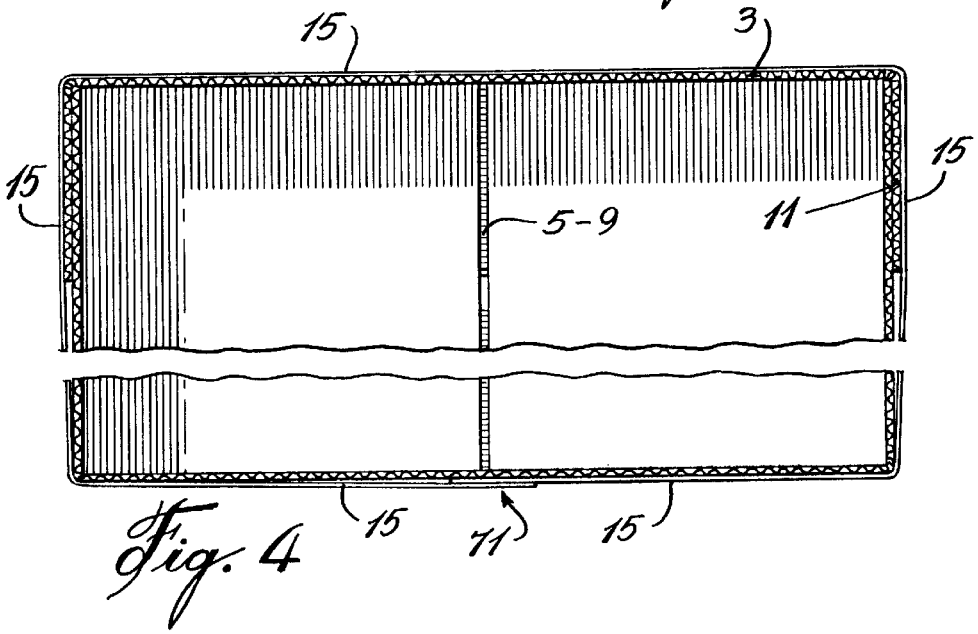
FIG. 4 is a transverse cross-section view through the carrier box illustrated in FIG. 1.

Cover 3 is made from a substantially rectangular blank A as particularly in FIG. 3. Blank A is formed with a first set of flange-forming folding lines 17,19 which are parallel to one another and extend all the way from one side of the blank to the opposite side thereof. The blank also comprises slots 21, 23, 25 and 27 which, as shown, extend from respective folding lines 17,19 to other sides of the blank. In addition, a second pair of flange-forming folding lines 29,31, which are parallel to one another and are perpendicular to folding lines 17,19, are provided so that slots 21,25 and 23,27 are in the respective continuation of folding lines 29,31. To facilitate the production of cover 3, blank 1 has four cut-out portions at the comers thereof so that each tab 33, 35, 37 and 39 formed by folding along flange-forming folding lines 17,19, will have an angular edge 41, 43, 45 and 47.

It will therefore be realized that, to form cover 3 of the carrier box according to the invention, flanges 7 and 11 are first folded downwardly along flange-forming folding lines 29,31, respectively. Tabs 33, 35, 37 and 39 are then folded inwardly. This is followed by a downward folding of flanges 5 and 9 along folding lines 17,19 and finally adhesively combining tabs 33,39 and 35,37 respectively against the inner faces of tabs 5 and 9.

Figure 2:
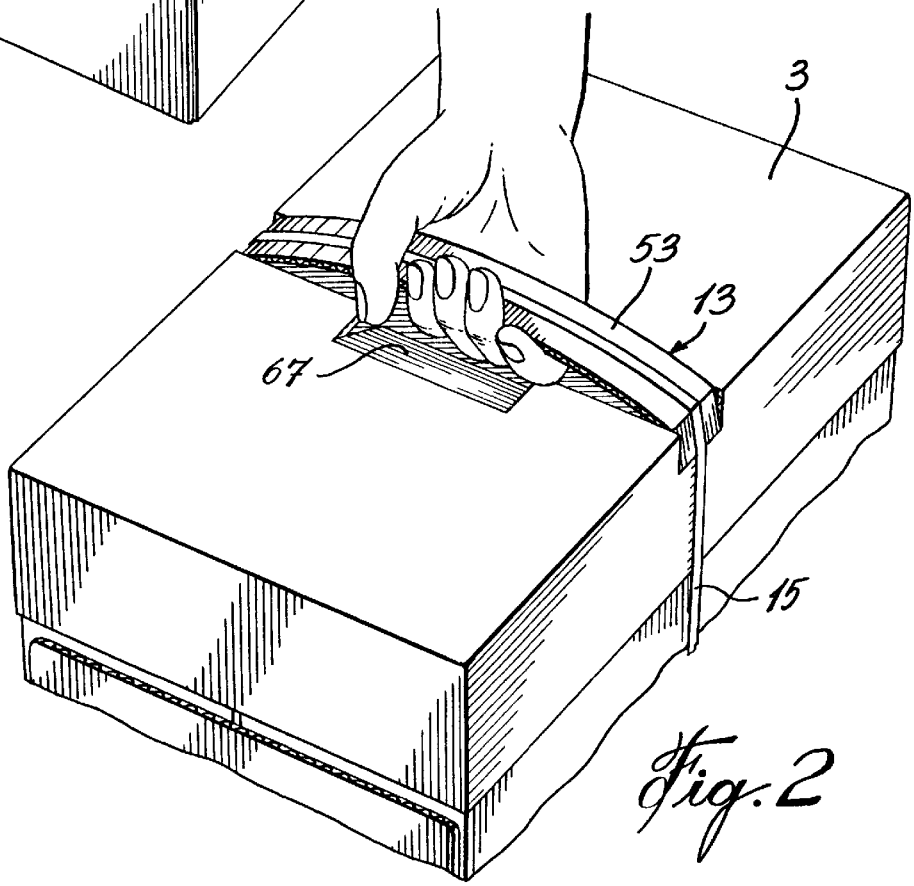
FIG. 2 is a partial perspective view showing the carrier box being grabbed by the handle.
Figure 5:
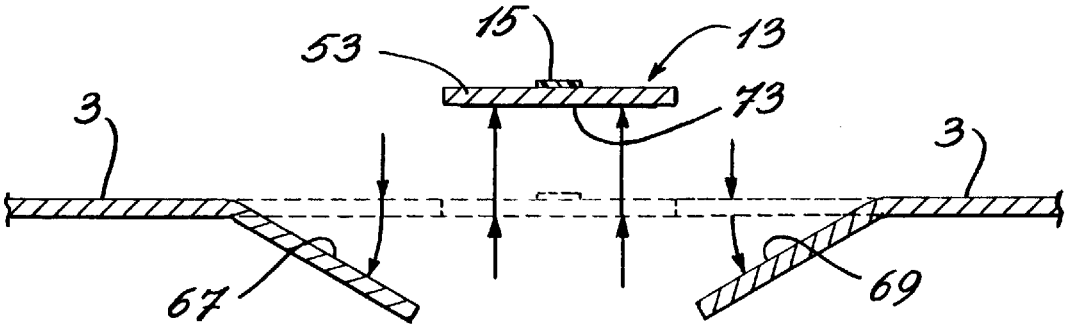
FIG. 5 is a partial cross-section view showing the handle and belt in raised position and the flaps in depressed position.
Figure 6:
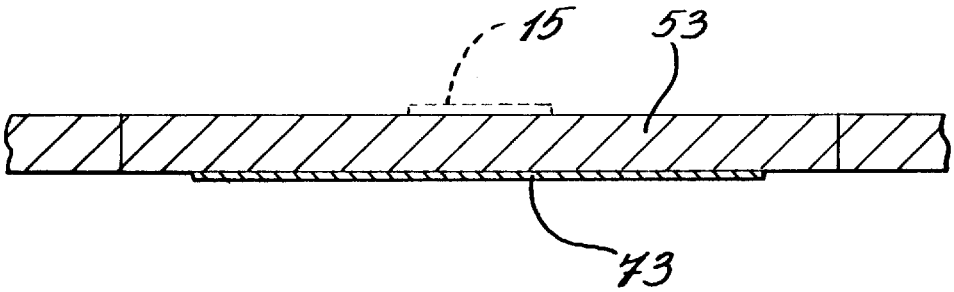
FIG. 6 is a cross-section view of the handle portion in storage position of the carrier box, taken along line 6—6 of FIG. 3.

The blank additionally comprises a pair of transverse parallel cuts 49,51 which extend all the way between folding lines 29,31 and past these two folding lines as shown in FIG. 3, sufficiently to enable band 53 which is formed to arch upwardly as shown in FIGS. 2 and 5 when being pulled, thereby forming handle 13.

Blank A additionally comprises intermediate folding lines 55,57 which, as shown in FIG. 3, are located intermediate between cut 49 and folding line 17 and cut 51 and folding 19, respectively. The ends of folding lines 55,57 are connected to cuts 49,51 respectively by means of cuts 59, 61, 63 and 65. It will be seen, with particular reference to FIG. 5, that these intermediate folding lines and secondary cuts will form tabs 67,69 which can be pushed downwardly as shown in FIG. 5 while the band 53 is pulled upwardly to form handle 13.

When the cover is formed from blank A, it is placed over bottom part 1 and belt 15 is fixedly wrapped around the box to cover the top surface of band 53, as particularly shown in FIG. 1. To provide for a stronger handle, its inner face is adhesively covered with a reinforcing tape 71. Anyone skilled in the art would know the material to be used to manufacture belt 13 and reinforcing tape 71.

Figure 7:
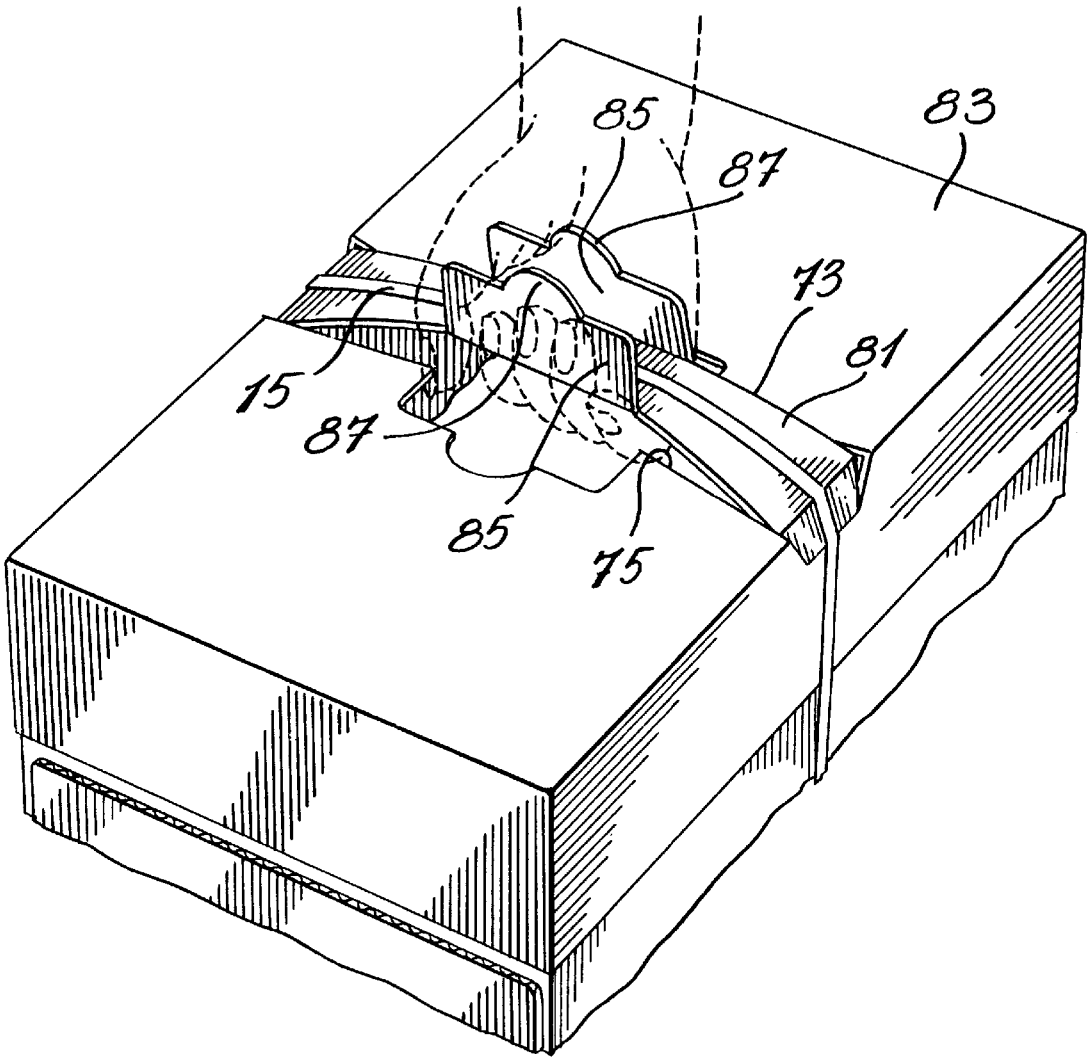
FIG. 7 is a perspective view of another embodiment of the container according to the invention.
Figure 8:
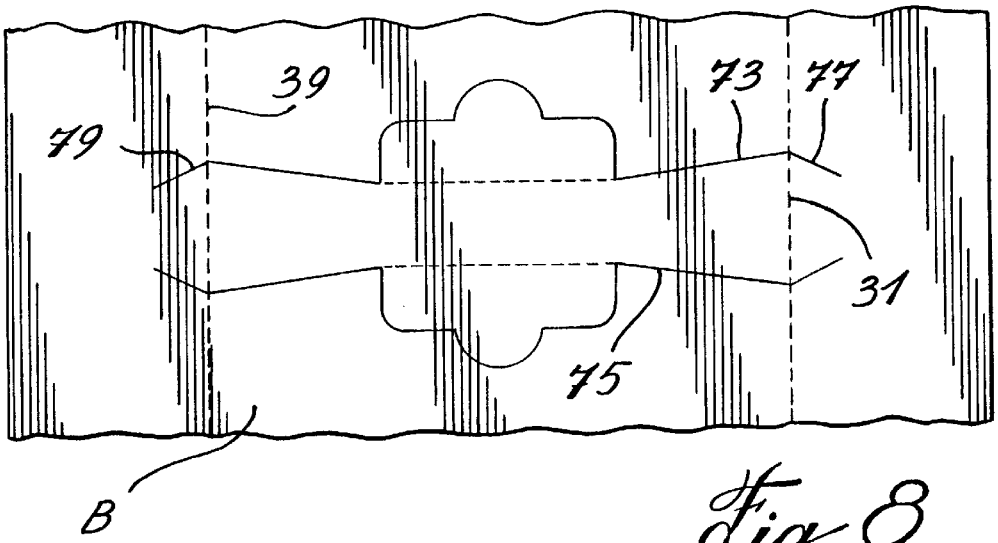
FIG. 8 is a partial view of the blank used to form the cover of the container illustrated in FIG. 7.
Figure 9:
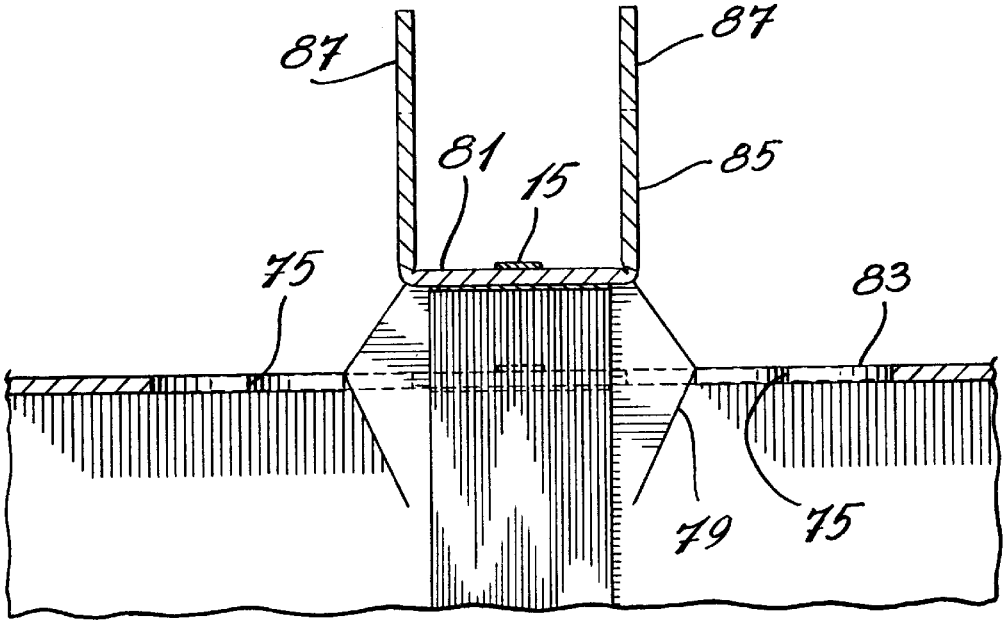
FIG. 9 is a cross-section view of the handle taken in the middle part with the tabs in upward position.

Turning now to the embodiment illustrated in FIGS. 7, 8 and 9, it will be seen that the container is generally the same as previously described except that there is a modification to the handle to make it easier to be manipulated and also stronger. To achieve this, different transverse cuts 73, 75 are provided. Since both are the same except that one is the image of the other, only cut 73 will be described. As shown more particularly in FIG. 3, cut 73 extends all the way from folding line 31 to folding line 39 and also past them a short distance respectively 77 and 79. As is the case of the previously described embodiment, these extensions 77, 79 of cuts 73, 75 enable band 81 to arch upwardly as shown in FIG. 7 when it is pulled by a hand grabbing it.

Referring again to FIGS. 7 and 8, in the middle part of cover 83 and consequently of blank B, cut 73 outwardly deviates to form a rectangular upwardly folding tab 85. It will also be noted that along the rectangular outline of cut 73 there is a further deviation in half circular shape to define tongue 87 which helps in pulling and upwardly folding tab 85 as shown in FIG. 7.

Finally, so as to provide a stronger band 81 which is also easier to grab, cuts 73 and 75 are oriented in such a way that band 81 is the widest along folding lines 31, 39 and that it narrows down first from folding lines 31, 39 until reaching folding tab 85 and second to the end of portions 77, 89 where band 81 becomes narrowest.

Of course, reinforcing tape 15 is mounted similarly as in the previously described embodiment.

We claim:

1. Container for printed paper or the like, which comprises a rectangular bottom part to contain said paper, a rectangular cover made of a substantially rectangular blank having flange-forming folding lines provided therein to define peripheral flanges enabling to fit said cover over said bottom part, said flange-forming lines being placed on said blank to coincide with upper edges of said cover, said blank additionally comprising a pair of transverse cuts which extend side by side all the way between a pair of said flange forming lines to form a first portion of a band, said transverse cuts also extending past said pair of folding lines in opposite direction to form a second portion of said band, said first and second portions combining to enable said band to arch upwardly when said band is being pulled, thereby forming a handle in said container, the first portion of each cut extending linearly from said pair of flange forming folding lines towards a middle part of said blank where said cut outwardly deviates to define an upwardly folding tab, and a reinforcing belt to wrap around said bottom part and said cover over said band when said cover is in position over said bottom part, and means enabling said reinforcing belt to follow and remain in substantial contact with said band when said band is formed into said handle.

2. Container according to claim 1 wherein in said middle part said cut deviates along a rectangular outline, and thereafter returns to a linear extension to reach an opposite folding line.

3. Container according to claim 2 wherein said cut additionally deviates to form a tongue along an outer side of said rectangular outline.

4. Container according to claim 3 wherein said tongue is half circular.

5. Container according to claim 1 wherein said band narrows down in said first portion from said folding lines to said folding tab and in said second portion from said folding lines to ends of said band.

6. Container according to claim 1 wherein at least said cover is made of cardboard.

7. Container according to claim 1 wherein said bottom part and said cover are both made of cardboard.

8. Container according to claim 1 wherein a first pair of said folding lines which are parallel to one another extend all the way from one side of said blank to the opposite side thereof.

9. Container according to claim 8 wherein said blank comprises slots which extend from said first pair of flange-forming folding lines to the remaining sides of said rectangular blank, a second pair of said folding lines being provided parallel to one another and perpendicular to said first pair of folding lines, said slots being in the continuation of said second pair of said folding lines, said slots-defining folding tabs at all comers of said rectangular blanks.

10. Container according to claim 9 wherein said cover is formed by downwardly folding flange portions between said tabs along said first flange-forming folding lines, folding along said second flange-forming folding lines, and finally folding said tabs against said flange portions.

11. Container according to claim 1 which comprises a reinforcing tape applied against the under face of said handle.

12. Container according to claim 11 wherein said belt is made of plastic material.

* * * * *